US009441372B2

(12) United States Patent
Swenters

(10) Patent No.: US 9,441,372 B2
(45) Date of Patent: Sep. 13, 2016

(54) STRUCTURAL MEMBER IN FRAMEWORK STRUCTURES

(71) Applicant: Ivo Swenters, Opblabbeek (BE)

(72) Inventor: Ivo Swenters, Opblabbeek (BE)

( * ) Notice: Subject to any disclaimer, the term of this patent is extended or adjusted under 35 U.S.C. 154(b) by 0 days.

(21) Appl. No.: 14/410,558

(22) PCT Filed: Jun. 17, 2013

(86) PCT No.: PCT/BE2013/000030
§ 371 (c)(1),
(2) Date: Dec. 22, 2014

(87) PCT Pub. No.: WO2013/185186
PCT Pub. Date: Dec. 19, 2013

(65) Prior Publication Data

US 2015/0315787 A1 Nov. 5, 2015

(30) Foreign Application Priority Data

Jun. 15, 2012 (BE) ..... 2012/0405

(51) Int. Cl.

| | |
|---|---|
| ***E04B 1/18*** | (2006.01) |
| ***E04B 5/10*** | (2006.01) |
| ***E04B 5/18*** | (2006.01) |
| ***E04C 3/02*** | (2006.01) |
| ***E04C 3/07*** | (2006.01) |
| ***E04C 3/32*** | (2006.01) |
| ***E04B 1/24*** | (2006.01) |
| ***E04C 3/08*** | (2006.01) |
| *E04C 3/04* | (2006.01) |

(52) U.S. Cl.

CPC ..... *E04C 3/07* (2013.01); *E04B 1/2403* (2013.01); *E04C 3/08* (2013.01); *E04C 3/32* (2013.01); *E04B 2001/2415* (2013.01); *E04B 2001/2448* (2013.01); *E04B 2001/2451* (2013.01); *E04B 2001/2457* (2013.01); *E04B 2001/2466* (2013.01); *E04B 2001/2469* (2013.01); *E04B 2001/2472* (2013.01); *E04B 2001/2484* (2013.01); *E04B 2103/06* (2013.01); *E04C 2003/0421* (2013.01); *E04C 2003/0478* (2013.01); *E04C 2003/0491* (2013.01)

(58) Field of Classification Search

CPC .... E04C 3/07; E04C 3/32; E04C 2003/0421; E04C 2003/0478; E04C 3/08; E04B 1/2403; E04B 2001/2415; E04B 2001/2448; E04B 2103/06; E04B 2/7457; E04B 2001/2451

USPC ..... 52/238.1

See application file for complete search history.

(56) References Cited

U.S. PATENT DOCUMENTS 3,688,461 A * 9/1972 Rensch et al. ..... 52/653.1
5,240,089 A * 8/1993 Spera ..... 182/186.7

(Continued)

*Primary Examiner* — Brian Mattei
(74) *Attorney, Agent, or Firm* — McCarter & English, LLP

(57) ABSTRACT

Elongated and thin-walled structural member (10) with several views (101, 102, 103, 104) extending along a longitudinal axis so that the member exhibits multiple rotational symmetry around the longitudinal axis (9). Each rotationally symmetric view includes a support surface (11) as support and fastening point for a wall facing and a connection surface (12, 12') for fastening of the member to other structural members. It is characteristic that the connection surface (12, 12') is disposed recessed with respect to the support surface (11) and at a spacing so that, when the member is fastened with ordinary fastening means via the connection surface, the fastening means do not protrude from the support surface. The connection surfaces (12, 12') are provided with a regular pattern of holes (13) to serve as passages for the fastening means. An assembly of such structural members is also described.

23 Claims, 10 Drawing Sheets

(56) References Cited

U.S. PATENT DOCUMENTS 5,471,810 A * 12/1995 Sugisawa et al. ..... 52/836
6,336,298 B1 * 1/2002 Chou ..... 52/238.1
7,823,347 B1 * 11/2010 Blinn ..... 52/244
2005/0034414 A1 * 2/2005 Unverzagt et al. ..... 52/731.1
2005/0055969 A1 * 3/2005 Simmons ..... 52/720.1

* cited by examiner

STRUCTURAL MEMBER IN FRAMEWORK STRUCTURES

This application is a national stage application of international application no. PCT/BE2013/000030 filed Jun. 17, 2013 entitled "Structural Member in Framework Structures," claiming benefit under 35 U.S.C. §119(a)-(d) of Belgian application no. BE2012/0405 filed Jun. 15, 2012, which are hereby expressly incorporated by reference as part of the present disclosure.

The present invention is related to an elongated member for use as a structural or load-bearing member in metal structures, especially structures for housing construction or construction of multifunctional buildings.

The erection of multifunctional buildings, such as office buildings, and houses, based on a metal framework or skeleton that serves as support structure, is known. The framework is provided with a facing along both the outside and the inside, such as sandwich panels along the outside and gypsum boards along the inside. Possible embodiments of the metal framework are described in the following publications, among others: FR 2882073, US 2007/193143, US 2008/047225 and WO 2004/051014.

Buildings are generally each unique structures erected according to a plan. In other words, considerable customization is involved. During erection of the metal framework this is expressed by cutting the different framework elements to size and making connection holes in the correct location in a framework element, which must agree with the connection holes made in the framework element to be connected to it. Elements with different cross sections in the framework are also used. At the joints, where different elements come together and are joined to each other, specific connection pieces are used, as shown, for example, in US 2007/193143.

All this makes it clear that an enormous number of different pieces are used in the construction of such framework or support structures, which consequently requires well-performing logistics in order to prevent discovering at the construction site that a number of pieces do not have the correct dimension or that the connection holes do not coincide. This would invariably lead to major delays.

Document U.S. Pat. No. 7,823,347 describes a structural member formed from a tubular main member on which radially extending longitudinal flanges are provided. The flanges are provided with a regular pattern of holes, to which other members can be joined by means of auxiliary pieces. The member of U.S. Pat. No. 7,823,347 can serve as a supporting element in a framework structure, but not as support for fastening of facing panels. If one intends to attach a facing panel, additional profiles must consequently be provided, connected to the supporting element. This makes the structure heavy and requires a larger amount of material and profiles of different shape.

Document CH 428149 describes a profile with a cruciform cross section for use in metal framework structures. Such a profile permits identical profiles to be fastened perpendicular to each other. To achieve this, a recess is provided on the crosscut end of a profile so that shape agreement is obtained with the side edge of the other profile to which the first profile is attached. Corresponding holes are then drilled through both profiles, whereupon the profiles are fastened to each other by means of brackets. Also in this case, providing the recess in the crosscut end is time-consuming.

Another problem in such support structures is the fact that the connection elements, which mostly consist of blind rivets, brackets or screws, protrude from the surface on which the facing walls are mounted. This naturally makes proper installation of the facing panels difficult.

The present invention aims at overcoming the problems from the prior art. In particular, the present invention aims at greatly simplifying logistics in load-bearing framework structures.

Objectives of the present invention are also to arrive at simplified framework structures, to limit the number of different elements to be employed and to provide simplified connections between framework elements. In short, it is an objective of the invention to arrive at more cost-effective framework structures.

It is also an objective of the invention to provide support elements and the corresponding connection pieces for load-bearing framework structures that permit rapid and accurate mounting of facing panels.

According to an aspect of the invention, there is therefore provided a structural member for use in load-bearing framework structures, as set out in the appended claims. The structural member, which is elongated and preferably made from a thin-walled material, preferably has an internal cavity extending along the longitudinal axis (i.e., is tubular). This cavity and the external shape of the structural member, when viewed in cross section, have essentially a same shape. In other words, the internal and external shapes are merely separated by the thin wall of the structural member.

The structural member has several views extending along a longitudinal axis. The views are formed so that the member exhibits a multiple rotational symmetry along the longitudinal axis, wherein each rotationally symmetric view comprises a support surface provided as a support and fastening point for a wall facing and comprises two connection surfaces provided for fastening of the member to other structural members. The support surface is positioned between the two connection surfaces and is parallel to them. According to the invention, the connection surfaces are recessed with respect to the support surface, the spacing being such that, when the member is fastened with ordinary fastening means via the connection surface, the fastening means do not protrude from the support surface.

According to a preferred aspect of the invention, the connection surfaces are provided with a regular pattern of holes. The holes of this pattern are provided to serve as passages for the fastening means.

The provision of distinguishable support surfaces and connection surfaces, in which the latter are recessed relative to the support surfaces, in combination with the multiple rotational symmetry results in a member that can be used with considerable versatility as a support element in framework structures. The hole pattern in the connection surfaces permits very rapid assembly of various like members, in which case they are attached to each other via the recessed connection surfaces. In this way the protruding support surfaces remain completely free of protruding obstacles, like screw heads, so that wall facings can advantageously be supported fully by the support surfaces.

The fact that the member has a corresponding shape externally and internally refers to the fact that, when the member externally has e.g. the form of a Greek cross, the internal cavity must also have the form of a Greek cross. In other words, the internal cavity must have a shape that can be recognized as the same shape as the external shape of the member. More specifically, the external shape and the shape of the internal cavity are separated by a distance, perpendicular to the circumference, which is equal (everywhere) to the wall thickness of the thin-walled material. This wall thickness is preferably constant around the circumference of the structural member. It should be noted that the fact that the member exhibits a corresponding shape externally and internally does not mean that the internal and external shape must be similar or congruent.

More specifically, reference is made to the fact that the internal cavity includes surfaces that correspond to the external support surfaces and connection surfaces. In other words, the support surfaces and connection surfaces must have a definite width so that, after subtraction of the wall thickness, space remains to insert fastening devices (for example, screws, blind rivets) through the support surfaces and the connection surfaces (for fastening of, for example, wall facings to the support surfaces).

As will become apparent below, framework structures can be obtained in this manner based on just one type of member so that construction becomes much simpler, which saves cost and space.

According to a second aspect of the invention, an assembly as set out in the appended claims is provided. The assembly includes at least two such structural members, which are joined to each other by means of a connection piece and fastening means.

According to a third aspect of the invention, a framework structure is provided as set out in the appended claims. The framework structure comprises such an assembly.

Embodiments with additional advantages are set out in the dependent claims.

Aspects of the invention will be explained below with reference to the following figures.

Figure 1:
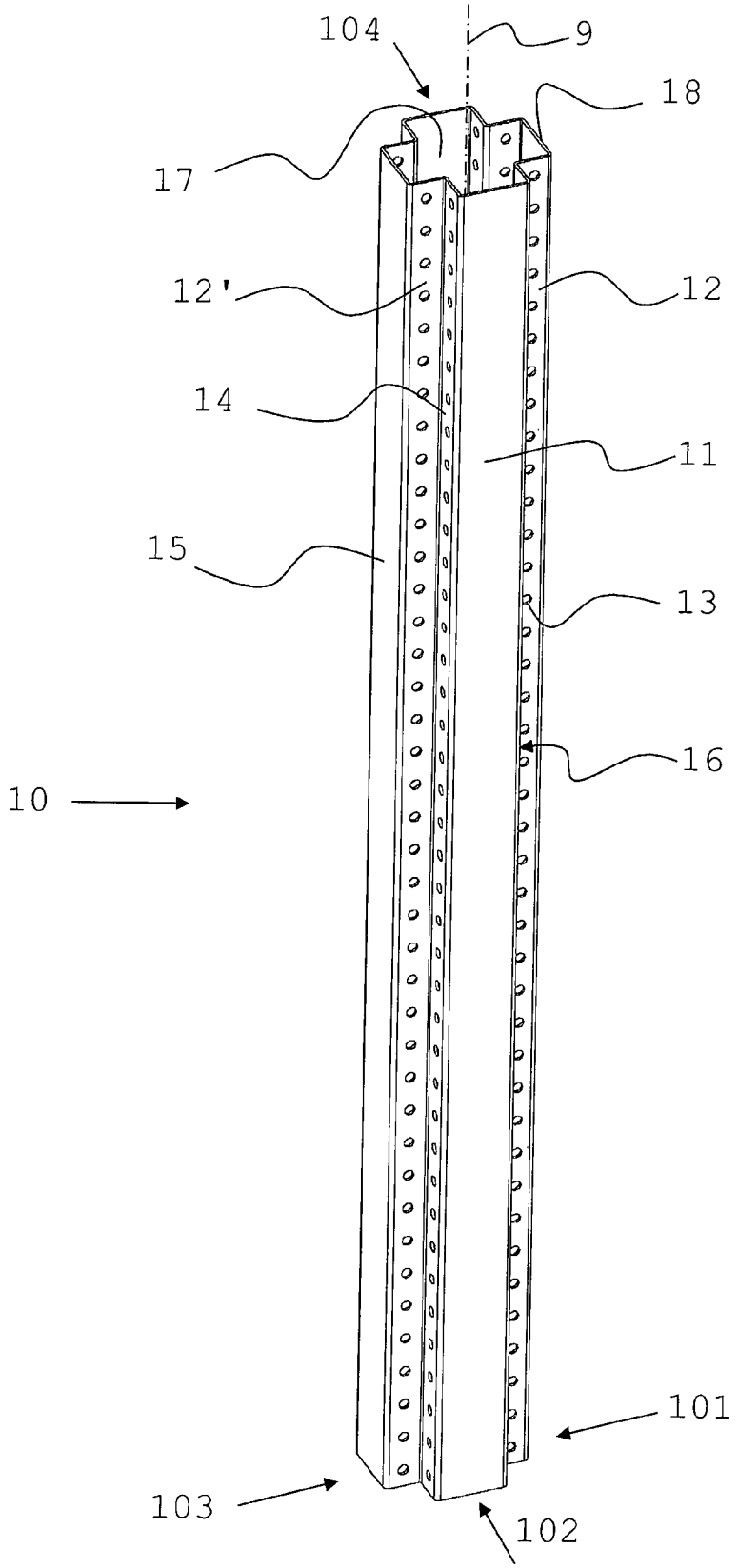
FIG. 1 shows a perspective view of a structural member according to the invention.

FIG. 1 shows a structural member 10, which embodies the aspects of the invention. Member 10 is elongated with a length along a longitudinal axis 9 that is significantly greater than the dimensions in a plane positioned at right angles to longitudinal axis 9.

Member 10 advantageously has multiple rotational symmetry around longitudinal axis 9. Members according to the invention can have two-fold or even three-fold rotational symmetry. FIG. 1 shows member 10, which advantageously has four-fold rotational symmetry around longitudinal axis 10. This means that the same shape is retained (in cross section) during each rotation over an angle of 90° around longitudinal axis 9. The advantage of this will become clear below.

Multiple rotational symmetry gives member 10 a number of views according to the directions 101-104 at right angles to the longitudinal axis 9, which are retained during corresponding rotation. Views according to directions 101-104 consequently extend along longitudinal axis 9. Each view will be referred to below, based on the viewing direction 101-104 that determines the view.

Each of the (rotationally symmetric) views 101-104 is formed by a first surface 11 and second surfaces 12, 12' recessed relative to the surface 11. In other words, first surface 11 is positioned protruding with respect to the second surfaces 12, 12'. Both the first surface 11 and the second surfaces 12, 12' advantageously protrude along longitudinal axis 9 and are advantageously parallel to it. The first surface 11 and the second surfaces 12, 12' are advantageously parallel.

The applications for such a member 10 are mostly in the construction industry, especially as a post or beam in framework structures of buildings that are erected according to the aforementioned method.

The first surface 11, on the one hand, and the second surfaces 12, 12', on the other, are provided in this case to perform differing functions. The first surface 11 can advantageously be used as a support and fastening surface for wall facings. Surface 11 will be referred to subsequently as support surface. The second surfaces 12, 12' are advantageously used as connection surfaces with space to apply fastening means, like screws and blind rivets, in order to join the member 10 to other preferably identical members 10 that make up the framework structure. The second surfaces 12, 12' will subsequently be referred to as connection surfaces.

By arranging the connection surfaces 12, 12' recessed relative to the support surface 11 it is achieved that a space is formed within which any connection pieces and fastening means can be positioned without protruding with respect to the support surface. This permits the framework structure to be assembled without having to consider any wall facings or other parts that are to be suspended on the framework structure. The support surfaces 11 in the framework will always be free of protruding elements that hamper fastening of wall facings.

Because of multiple rotational symmetry it also follows that each of the rotationally symmetric views 101-104 has the aforementioned properties so that the member can be handled and used more easily.

The member 10 shown in FIG. 1 even represents a special case in which the view surfaces 101-104 are "woven" so to speak into each other. For example, wall 14 which joins support surface 11 to connection surface 12' and is at right angles to it, in fact forms one of the connection surfaces of view 103, which also includes support surface 15. Member 10 actually has a cross section in the form of a Greek cross with legs perpendicular to each other, in which the crosscut ends of the legs form the support surfaces (for example, support surface 11) and the side surfaces (14, 16) of the legs form the connection surfaces.

FIG. 1 shows that the support surface 11 is advantageously positioned between connection surfaces 12 and 12'.

Member 10 advantageously has a constant cross section. This means that member 10 can be considered a profile. The connection surfaces 12, 12', 14 also advantageously extend continuously along longitudinal axis 9. The support surfaces 11, 15 also advantageously extend continuously along longitudinal axis 9. An advantage of such "profiling" of members according to the invention is that they can be manufactured in standard lengths in order to be cut to the proper length on site or in the preparation shop. It is not necessary, but possibly advantageous, to keep the surfaces of the support surfaces flat. They can also be ribbed or notched.

Member 10 is preferably made from a thin-walled material 18. This ensures weight saving and also makes assembly possible with blind rivets or screws. Member 10 is shown in FIG. 1 as a tubular element (that is, with an internal cavity 17 running along the longitudinal axis 9 and enclosed by an uninterrupted cross section). Cavity 17 is enclosed by the thin-walled material 18, which also determines the external shape of the member 10. More specifically, the support surfaces 11 and the connection surfaces 12, 12' are formed by wall 18.

Support surface 11 advantageously not only serves as support surface for facing panels, but also permits fastening of these panels to member 10. For this purpose the support surface 11 extends between two connection walls 14, 16, which connect support surface 11 to connection surfaces 12, 12'. Connection walls 14, 16 are positioned at a spacing from each other so that space is formed throughout support surface 11 for mounting screws.

It will be noted that the connection walls 14, 16 are spaced apart so that the support surface 11 acquires a certain width. By so doing, it is also obtained that the external shape of (a cross section of) member 10 and the shape of the internal cavity 17 nearly correspond. In the particular example of FIG. 1, both exhibit the shape of a Greek cross. The difference between the two Greek crosses is formed by the wall 18 of member 10.

Steel is advantageously the material of preference, which makes it possible to manufacture member 10 by cold deformation, like cold rolling. Other metals or materials other than metals can also be used.

In order to ease fastening with other elements from the framework structure, the connection surfaces 12, 12' are advantageously provided with a regular hole pattern, for example, a row pattern of holes 13. These holes 13 form passages for fastening means with which the member 10 can be fastened to other members, as explained subsequently.

The passage 13 can refer to both a through-hole (for example, as a passage for the shank of a blind rivet) and a hole that itself ensures mechanical engagement with the fastening means, for example, provided with screw thread.

The passages 13 preferably pass through the wall of member 10.

Figure 2:
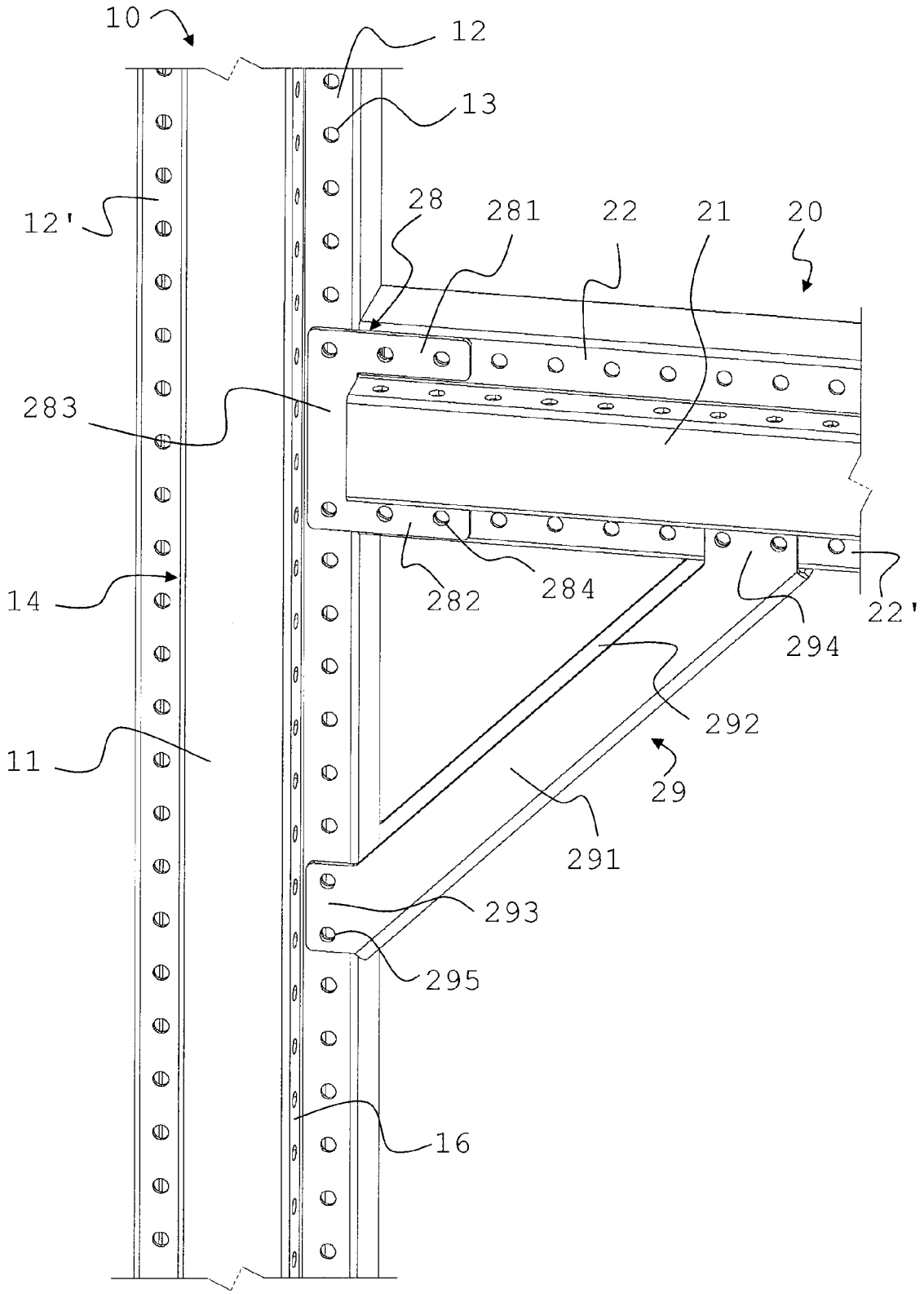
FIG. 2 shows a perspective view of an assembly of two identical members according to the invention, which are joined at right angles to each other.

FIGS. 2 to 6 show examples of how simple and advantageous use of the members 10 according to the invention can be in framework structures. FIG. 2 shows a connection at right angles of two identical members 10 and 20 according to the invention. Member 20 is arranged at right angles to member 10 and is joined to it with two C-shaped connection pieces 28, only one of which is visible in FIG. 2. The second connection piece 28 is in fact situated at the back side (with respect to the view of FIG. 2). Connection piece 28 is a flat piece, advantageously formed (cut) from sheet metal with two legs 281 and 282 joined to each other via an intermediate part 283. The opening between the two legs 283 (the length of the intermediate part 283) corresponds to the width of the protruding support surface 21. The width of the intermediate part 283 advantageously corresponds to the width of the connection surface 12. The width of the two legs advantageously corresponds to the width of the connection surfaces 22, 22'. Advantageously the widths of the legs 281, 282 and that of intermediate part 283 are the same.

Connection piece 28 is consequently formed so that it can be positioned over three connection surfaces 12, 22 and 22'. In so doing, it is possible to connect members 10 and 20 to each other by connecting two connection surfaces of one member with a connection surface of the other member via a single intermediate piece 28. The same result is obtained with a second identical C-shaped connection piece 28 on the back of members 10, 20.

Fastening of the connection piece 28 to connection surfaces 12, 22 and 22' of the two members 10, 20 advantageously occurs by means of blind rivets. These can carry a significant load in shear. When the connection surfaces 12, 22, 22' are provided with a regular hole pattern according to standardized spacings, the connection piece 28 can also be provided with a corresponding pattern of holes 284. The spacing between holes 13 coincides advantageously with the smallest spacing unit common in the corresponding field of application, for example, 25 mm. The diameters of holes 13 can also depend on the area of application. In the case of metal members 10, 20, the holes 13 can be made by punching during manufacture of a member 10.

Fastening of two members 10, 20 at right angles to each other via connection piece 28 already forms a very strong connection, since load transfer occurs almost exclusively by shear, with the understanding that member 10 is arranged vertically and member 20 is consequently horizontal.

If connection pieces 28 would be insufficient to support the anticipated load, then a bracing connection piece 29 can additionally be provided. Connection piece 29 is advantageously made simply by cutting and bending from sheet metal so that it acquires a U-shaped cross section with two parallel surfaces 291, 292 that form the legs of the U-shaped cross section. The spacing between the two surfaces 291, 292 advantageously corresponds to the width of the support surface 11, 21. Each of the parallel surfaces 291, 292 comprises a protruding lip 293, 294 on both ends, which is provided to be supported against a connection surface 12 or 22' respectively. The lips 293, 294 can be provided with holes 295 for fastening to member 10, 20. As an alternative, bracing connection piece 29 can be formed from two separate parts, namely surfaces 291 and 292, which are fastened to a front and back side of the setup (members 10, 20) respectively.

It is clearly apparent from FIG. 2 that, after connection by means of connection piece 28 and/or 29, the support surfaces 11 and 21 remain completely free and are moreover situated in one plane. The support surfaces 11 and 21 consequently form a support and fastening point for a possible wall facing, like gypsum boards and sandwich panels (for example, as outer cladding).

The spacing between support surfaces 11 and 21 and connection surfaces 12, 12', respectively 22, 22' is advantageously at least the sum of the thickness of the connection piece 28 or 29 and a protruding head of the employed fastening element, like the head of a blind rivet or a screw. Preferably this spacing is at least 15 mm, preferably at least 20 mm, preferably about 25 mm or possibly greater, which permits a head of a blind riveting tong to be pushed over a marker of a blind rivet in holes 13.

The aforementioned spacing also forms the width of the connection surfaces 12, 12', 22, 22'. This width is preferably at least 5 mm, preferably at least 10 mm, preferably at least 15 mm. At widths smaller than 15 mm screws are advantageously used for fastening in passages 13 because of the small dimensions.

The member 10 advantageously has outside dimensions such that the smallest square within which the cross section is inscribed has a side of at least 20 mm, preferably at least 40 mm, preferably at least 50 mm, preferably at least 70 mm. This side is preferably no greater than 200 mm.

From the design of member 10 it follows that the support surfaces 11, 15 preferably have a width of at least 20 mm, preferably at least 30 mm.

The wall thickness of the member 10 is preferably at least 0.5 mm, preferably at least 0.6 mm, preferably at least 1 mm. This wall thickness is preferably no greater than 3 mm.

It is also apparent from the arrangement of FIG. 2 that because of the four-fold rotational symmetry of members 10, 20 and because of the employed connection pieces 28, 29 four members 20 can advantageously be connected to member 10 at the same height at right angles, namely by 90°. For example, an additional member can be connected at right angles to member 10 so that it is positioned at right angles with respect to member 20 by connection to connection surfaces 14 and 16, which also form a connection wall between support surface 11 and connection surfaces 12' and 12, respectively.

Figure 6:
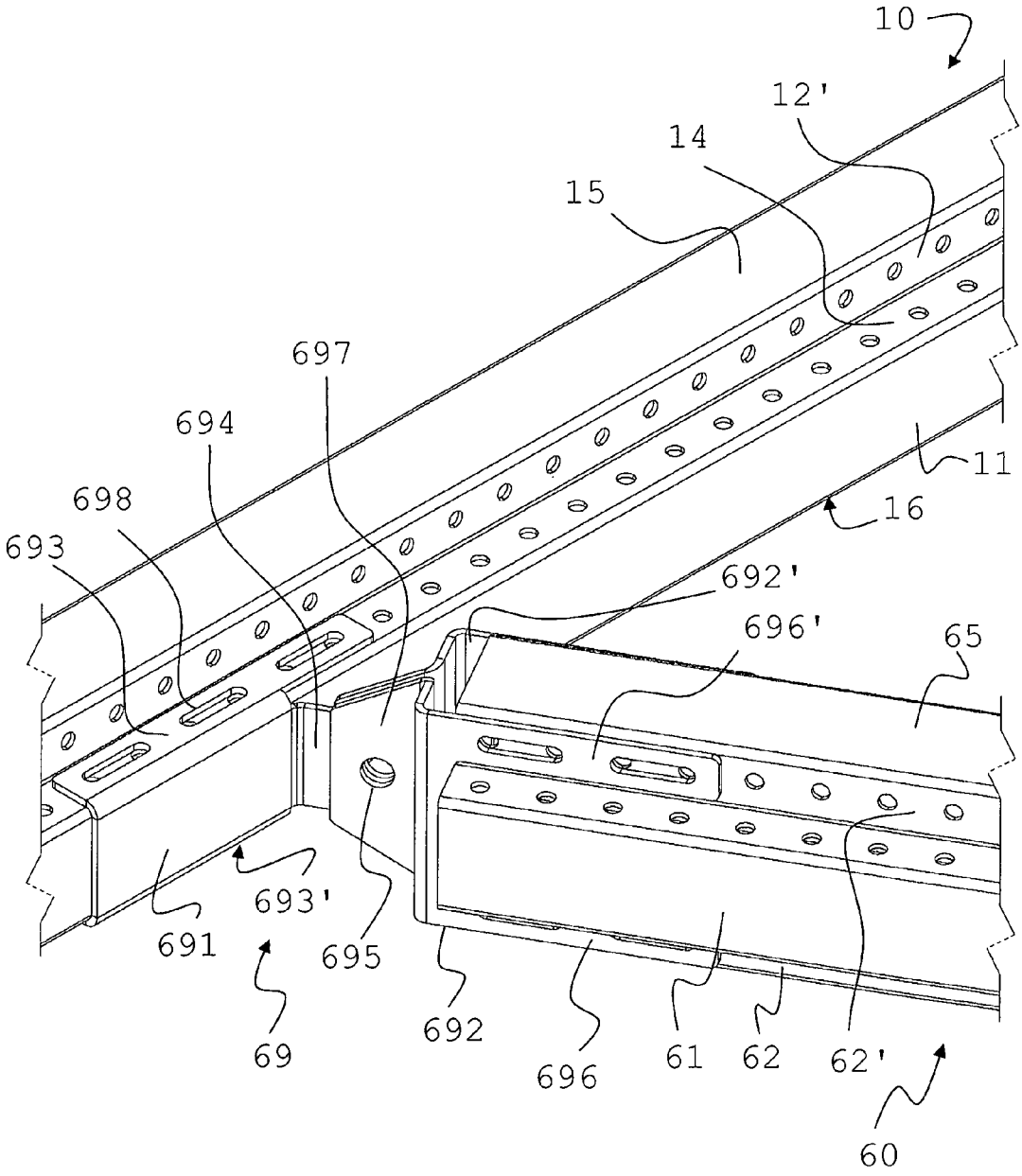
FIG. 6 shows a perspective view of two horizontally positioned identical members according to the invention, which are joined to each other under a non-perpendicular angle and by means of a three-part connection piece.

Multiple connections at the same height are possible according to the invention without using additional auxiliary profiles, as is common in the prior art (see, for example, FIG. 6 of US 2008/047225). Framework structures based on members according to the invention are consequently more compact than in the state of the art. This is expressed in the construction industry by greater usable inside surface with the same outside dimensions.

Figure 3:
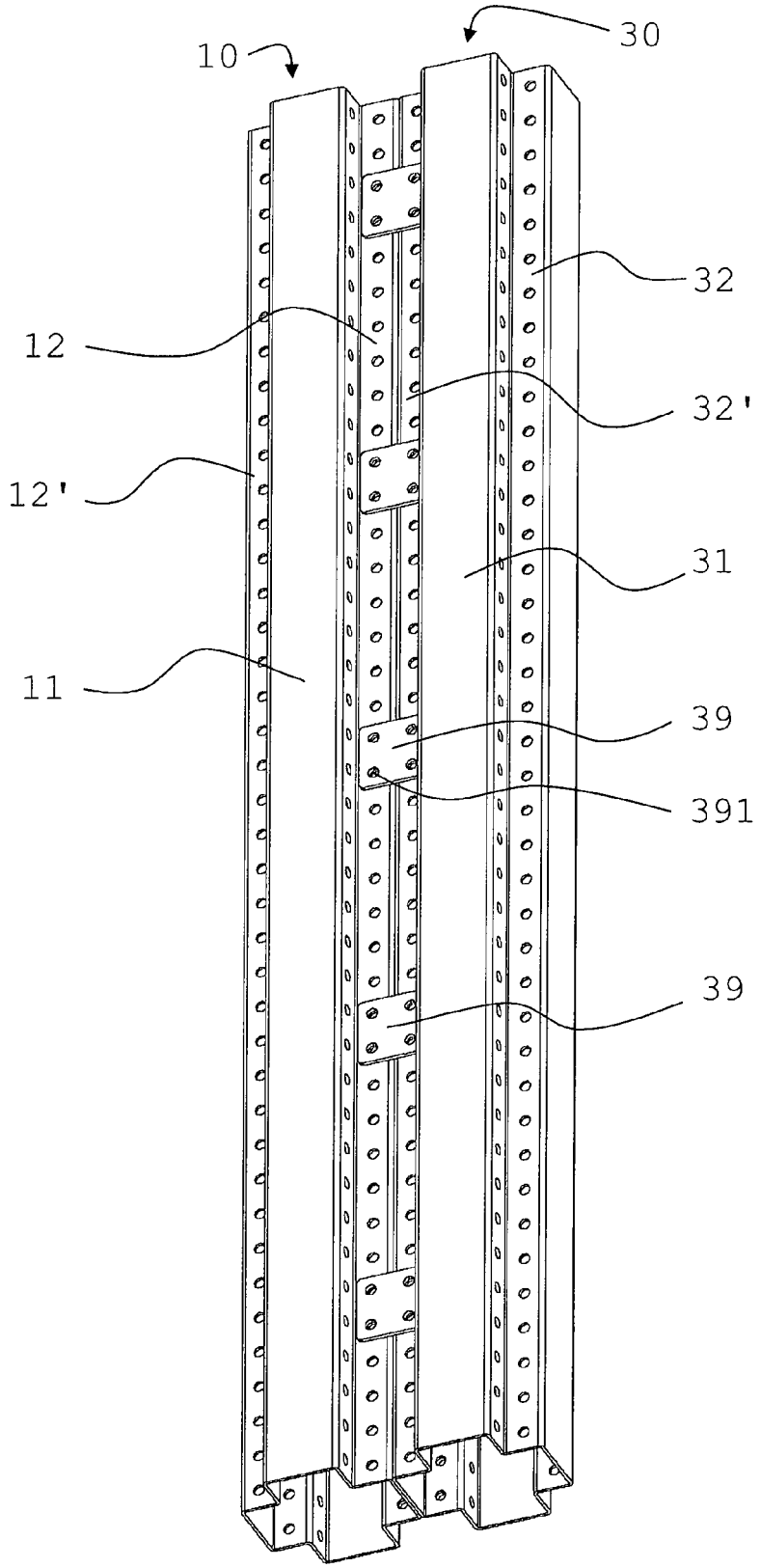
FIG. 3 shows a perspective view of an assembly of two identical members according to the invention, which are joined parallel to each other.

FIG. 3 shows a connection of two identical members 10, 30 parallel to each other. It is clearly apparent that positioning of the two members 10 and 30 parallel to each other results in positioning of all connection surfaces 12, 12', 32 and 32' of members 10 and 30 belonging to corresponding views in the same surface (i.e., being coplanar). The support surfaces 11 and 31 belonging to corresponding views are also coplanar. The advantage is that a connection between the two members 10, 30 can be simply produced by joining the connection surfaces 12 and 32' lying next to each other by means of connection plates 39. The connection plates 39 are very simple in shape—essentially square or rectangular—and are provided with holes 391, which coincide with holes 13 of the members 10 and 30. The same connection plates 39 can be mounted on the back side with respect to the view of FIG. 3.

Figure 4:
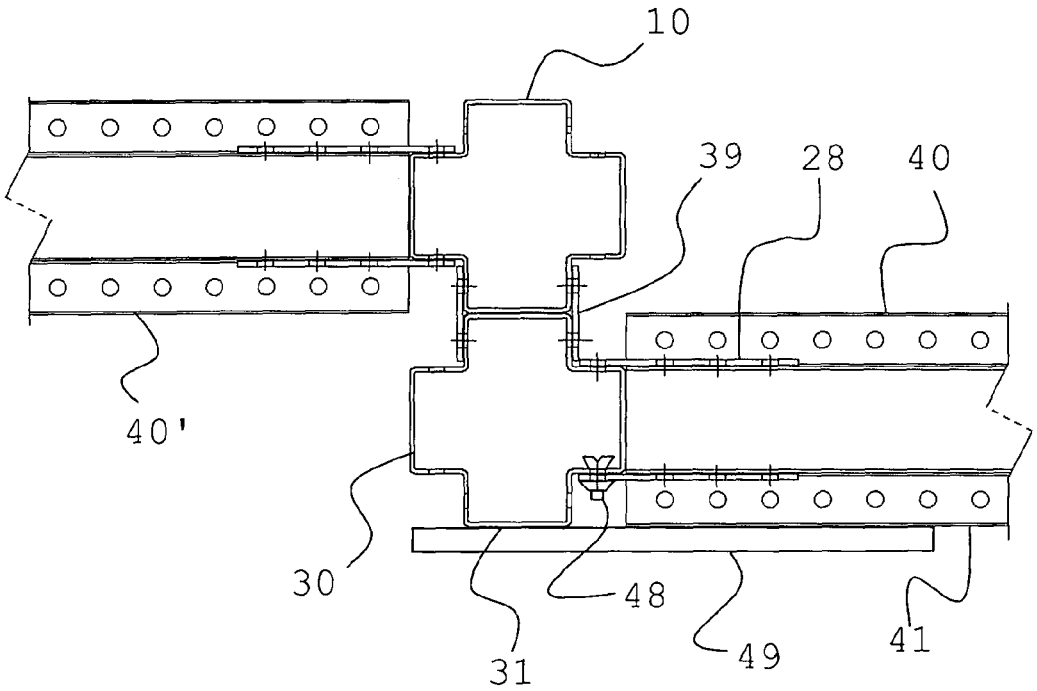
FIG. 4 shows a cross section of the assembly from FIG. 3, in which an identical member is joined at right angles to each of the two members, on a different side. The position of a facing panel on the members according to the invention is also shown.

By connecting two members according to the invention arranged parallel to each other, a support post or joist can be obtained with greater strength, using exclusively the same type of member. This type of solution also permits height differences in a floor to be spanned, as shown in FIG. 4. The assembly 10-30 is set up horizontally. A member 40' is attached at right angles to the uppermost member 10 on the left side. A member 40 is fastened at right angles to the lowermost member 30 on the right side. A height difference between joists can consequently be spanned in simple fashion by using only the same type of members and without making use of additional profiles with special shape.

FIG. 4 shows as an illustration a blind rivet 48 that connects a connection piece 39 to member 30. For clarity the dimensions of the blind rivet are exaggerated with respect to the members and the connection pieces. Although only one blind rivet is shown in FIG. 4, in practice a blind rivet is provided in each hole 13 that overlaps the connection pieces 39.

FIG. 4 also shows the positioning of a facing panel 49 on the support surfaces 31, 41 of members 30, 40 respectively. Since the support surfaces have protrusions and a certain width, the panel 49 can be simply fastened to members 30, 40, for example, with screws. It should be noted that the blind rivets 48 advantageously do not obstruct the facing panel 49.

Figure 5:
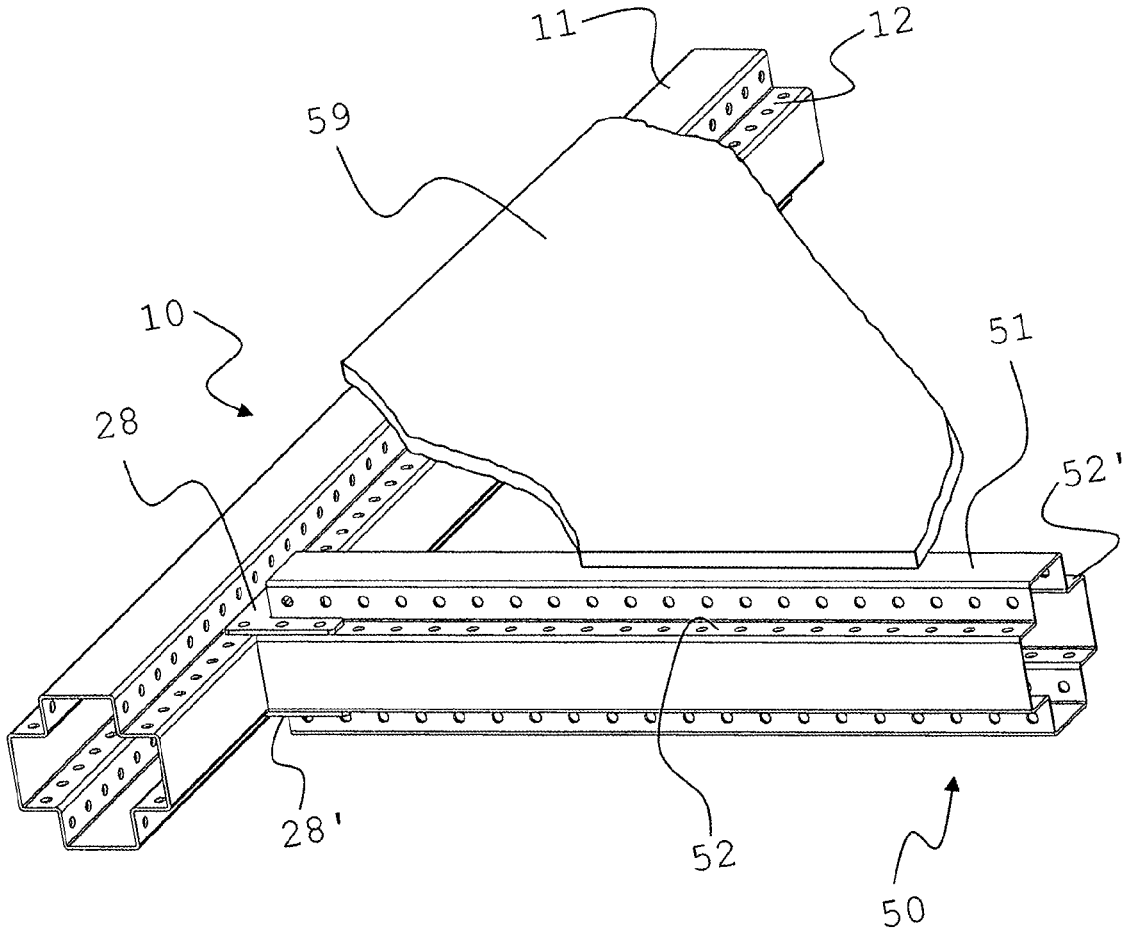
FIG. 5 shows a perspective view of an assembly of a connection of two identical horizontally positioned members at a right angle. A facing panel is also mounted on the assembly.

Fastening of two members at right angles in a same horizontal plane (as for members 30 and 40 on the one hand and 10 and 40' on the other) can occur with the same connection pieces 28, as shown in FIG. 2 for a vertical setup. The horizontal setup of such a T-connection is shown in FIG. 5. Members 10 and 50 arranged at right angles are connected by two connection pieces 28 and 28' positioned on the horizontal connection surfaces. Connection piece 28 is supported and connected to the connection surfaces 12 and 52, 52' of member 10, respectively member 50. The same applies for connection piece 28' along the bottom. The horizontal connection in FIG. 5 will be able to support a smaller load compared to a vertical arrangement, but this difference will be minimal, since the joint will also be torque-loaded, which ensures that the overlying connection piece 28 is loaded under tension.

FIG. 5 also shows the position of a facing panel 59 with respect to the assembly of members 10, 50. Panel 59 is supported on support surfaces 11 and 51 of members 10, 50 respectively.

FIG. 6 shows a possible method for connecting two identical members 10, 60 according to the invention at a non-perpendicular angle to each other. This occurs according to FIG. 6 by means of a three-part connection piece 69, which is formed by a first part 691, which is fastened to member 10, and two identical second parts 692, 692', which are fastened to member 60. In the present case the two members 10, 60 are not joined by corresponding connection surfaces (for example, 12' and 62'), but via connection surfaces arranged perpendicular to each other (for example, 14 and 62'). Alternative methods for connecting corresponding connection surfaces, however, are also possible.

The first part 691 of connection piece 69 is formed by a U-shaped profile, simple to manufacture from sheet metal. The profile is pushed over connection surface 14 or 16 with the legs 693, 693' and connected to it. The first part 691 includes a bent lip 694 on one end. This lip is provided with a hole 695, which will form a fastening point with part 692 and 692'. The latter second parts 692 and 692' are C-shaped with legs 696 and 696' and on the opposite side of them a protruding lip 697, which is arranged recessed with respect to legs 696. The second parts 692 and 692' are fastened to the connection surfaces of opposite views of member 60. Just as in connection piece 28, the legs 696, 696' are supported against the connection surfaces 62 or 62' of member 60 and are connected to them. The spacing between legs 696 and 696' is sufficient to allow the support surface 61 to protrude between it. The lips 697 of the parts 692 and 692' come together so that the bent lip 694 of the first part 691 fits between them. These can be connected through hole 695 by means of a bolt.

The fact that the connection surfaces 14, 16 and 62, 62' used for the connection are not coplanar but perpendicular, does not compromise the advantages according to the invention. That is because the result of the arrangement of FIG. 6 is based on the fact that support surfaces 15 and 65 of members 10, respectively 60 are coplanar and consequently form one top plane without protruding parts, like heads of rivets, interfering with the top plane. The same situation applies to the plane on the bottom of the arrangement (i.e., the opposite plane of the top plane 15, 65). For the construction industry this means that both the floor and the ceiling can be covered without problem.

The holes in legs 693, 693' and 696, 696' can advantageously be formed as slots 698, which offers the possibility of compensating for alignment errors.

The above-described corner joint with three-part connection piece 69 can also be used to obtain a perpendicular corner connection (T-connection). In this case lip 694 is bent over at a right angle.

Figure 7:
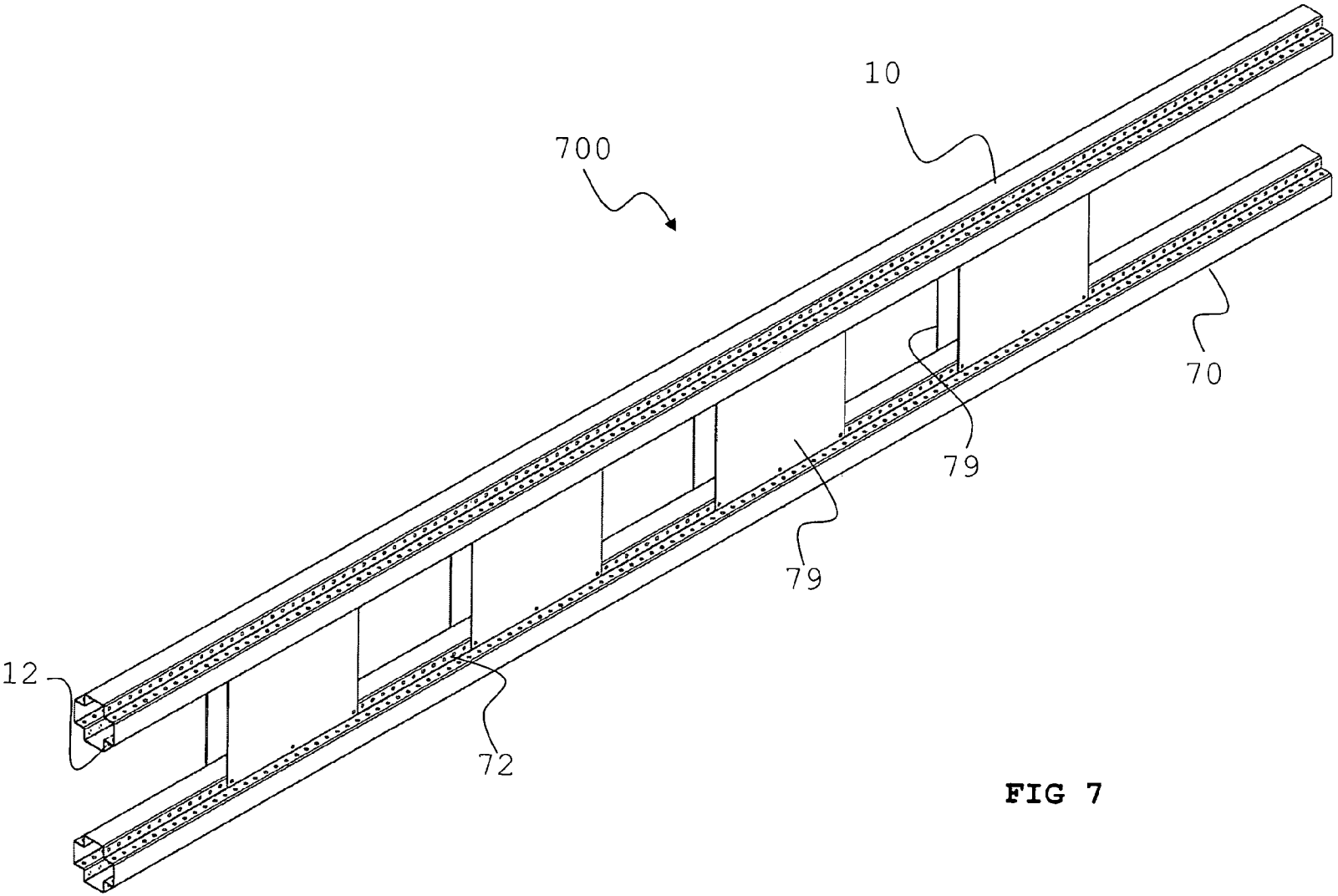
FIG. 7 shows a perspective view of a single assembled beam with two parallel identical members connected by connection plates.

FIG. 7 shows the assembly of two identical parallel members 10, 70 according to the invention to an assembled beam 700 or joist, in which the members 10, 70 form the flanges or ends of the beam. The two members are joined by connection plates 79, which are fastened to the coplanar connection surfaces 12 and 72. The same connection plate 79 can be provided on the back side. This assembly is analogous to the parallel assembly from FIG. 3, with the difference that the two members are positioned at a spacing from each other. The connection plates 79 are consequently also larger than the connection plates 39. They form the web of the assembled beam 700.

This principle can be applied until the connection plates 79 become too high and consequently would be too weak for buckling. Even stronger beams, however, can be assembled by connecting two or more of the assembled beams 700 from FIG. 7 to each other with their long edges so that the web is vastly reinforced and the web can be further extended in height without having to provide thicker connection plates 79.

Figure 8:
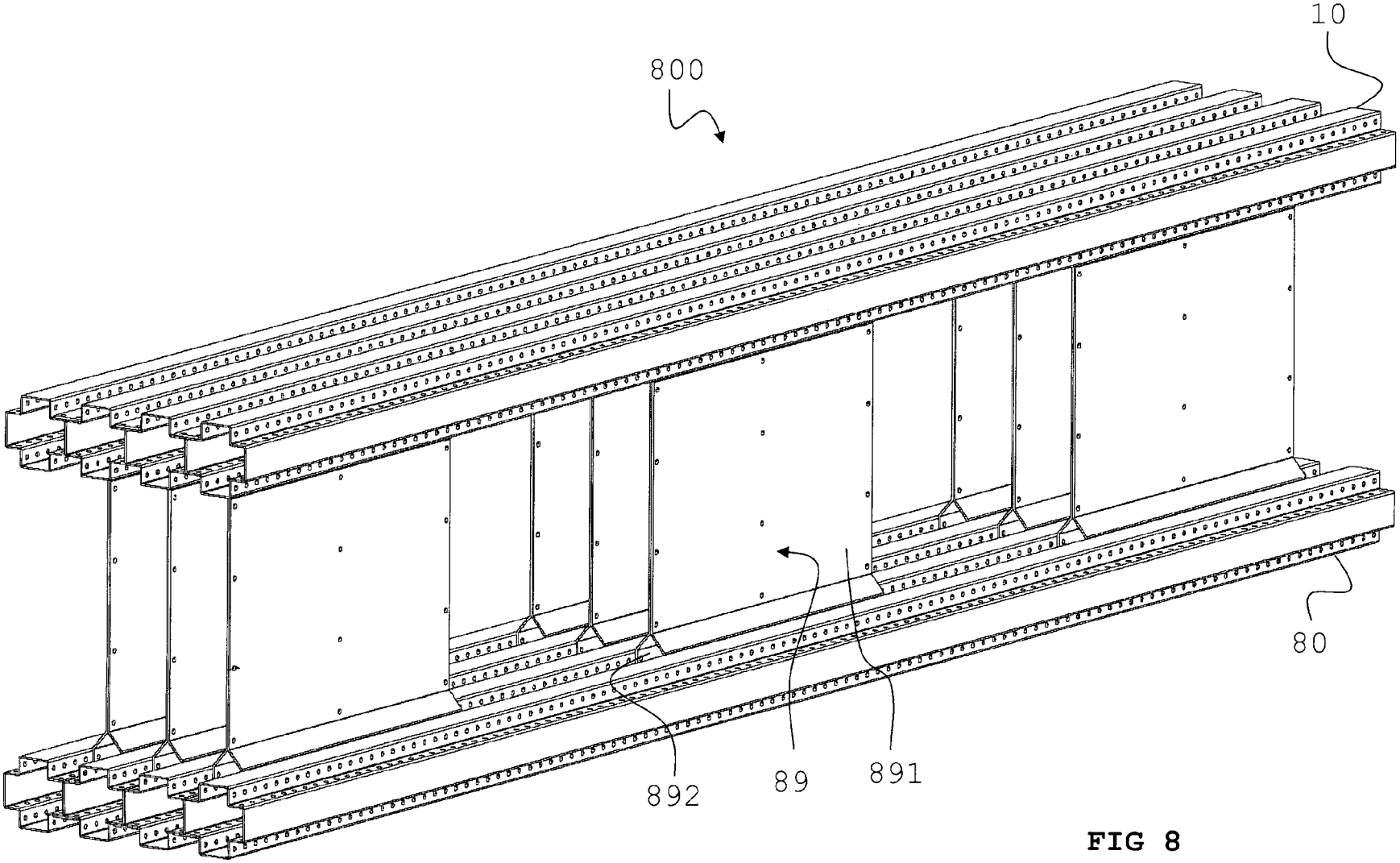
FIG. 8 shows a perspective view of a multiple assembled beam by juxtaposition of single assembled beams.
Figure 9:
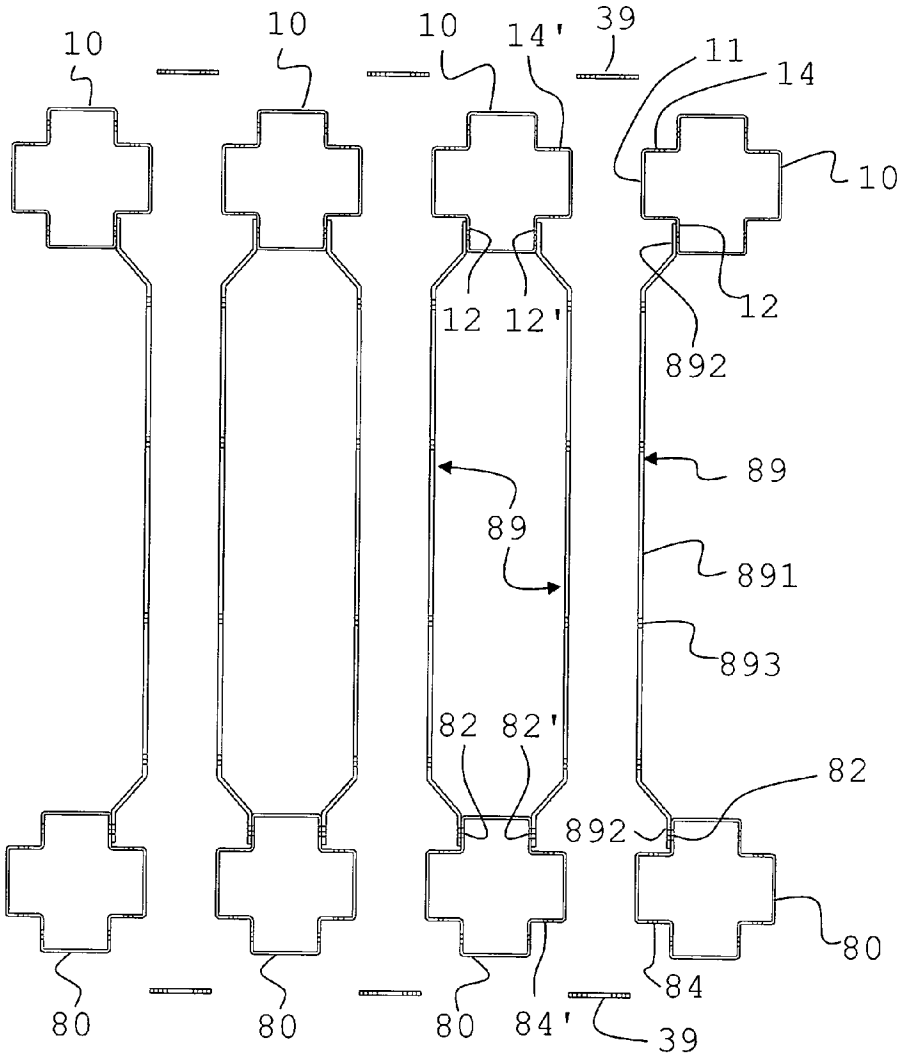
FIG. 9 shows an exploded view of a cross section of the multiple assembled beam of FIG. 8.

Such a multiple assembled beam is shown in FIGS. 8 and 9 and is formed from a juxtaposition of single assembled beams joined to each other. Connection plates 89 join the flanges (formed by identical members 10, 80) at a spacing from each other. In contrast to the completely flat connection plates 79, connection plates 89 include two edges 892, which protrude with respect to a center part 891, and which run parallel to the center part 891. The spacing between middle part 891 and edges 892 is as large as the spacing between connection surface 12 and support surface 11. Both the center part 891 and the edges 892 are provided with fastening holes 893.

The connection plates 89 are fastened via edges 892 to the coplanar arranged support surfaces 12, 82 and 12', 82' of the members 10, 80 and according to an orientation so that the center part 891 protrudes forward when one looks across the beam. When several single assembled beams are positioned next to each other so that opposite support surfaces 11 of the members 10, 20 touch each other, it will be noted that the center parts 891 of connection plates 89 also advantageously touch each other so that they can be joined to each other, for example, by means of blind rivets through holes 893.

Connection plates 39 can also advantageously be used in order to join support surfaces 14 and 14', respectively 84 and 84' to each other.

It will be noted that such connection plates 89 can also be used in single assembled beams 700 to replace the connection plate 79. In this case it is advantageous to orient the connection plates so that the center parts 891 are recessed (that is according to an inverse orientation to FIG. 9), so that opposite connection plates of the single assembled beam touch each other with the center parts.

In the multiple assembled beam 800 it will be noted that the external support surfaces of members 10, 80 both along the top and bottom of the beam and along the left and right sides remain completely free and that no connection part will protrude from the surfaces.

Members according to the invention can be provided with a measurement indication in order to easily determine the length of the piece. For example, a marking can be provided on the support surface at regular spacings (for example, every meter or every 0.5 m). When the connection surfaces are equipped with a regular hole pattern, these can be used to also determine the length visually (for example, by counting the number of holes that lie in front of the last marking).

It is apparent from the preceding that members according to the invention permit construction of a complete framework structure with the fewest possible different profiles and preferably based on the same support member. This leads to simplified structures that are space-saving and more economical than known structures. The logistics is greatly simplified, since one works with the same support member so that any defects can easily be solved on site. Because of the well-defined shape of the support members according to the invention, connections based on connection pieces that are very simple and inexpensive to produce can be accomplished.

Figure 10:
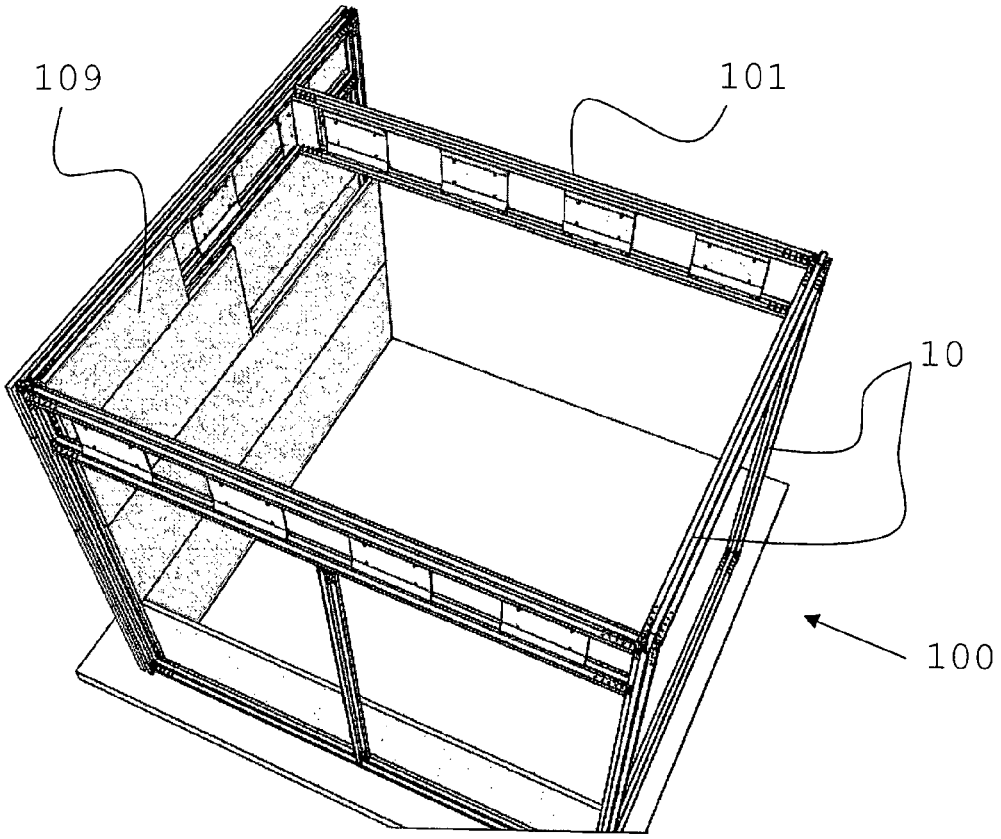
FIG. 10 shows a perspective view of a framework structure according to the invention.

FIG. 10 shows an example of such a framework structure. Framework structure 100 is constructed from an assembly of members 10 according to the invention. These members 10 are used for both the vertical supports and joists of the structure. The uppermost joists 101 are assembled from four members 10 (two along the top edge, two along the bottom edge of joists 101) according to the connection of FIG. 9. It is also readily apparent from FIG. 10 how simply the mounting of facing panels 109 can be accomplished. Because of the rotational symmetry the facing panels 109 can be mounted both along the inside and along the outside of the structure so that the actual framework can be completely covered. The facing panels 109 are mounted against the support surfaces of members 10 and fastened to them without experiencing obstacles from other fastening devices and without interruptions at the level of members 10. In so doing, a mechanically strong structure is obtained, which can simultaneously be finished in an aesthetically high-quality manner.

The use of structural members according to the invention is also not limited to the construction industry. These members can advantageously be used for structural applications in all types of framework structures, as in the construction of racks in storage facilities and distribution centers for example, and in structures for game and sports purposes.

The invention claimed is:

1. An assembly comprising a structural member and a panel attached to the structural member, wherein the structural member is elongated and defines an internal cavity which extends along a longitudinal axis of the structural member and is surrounded by a thin-walled material of the structural member, wherein the thin-walled material defines an external shape of the structural member in the form of a Greek cross and the internal cavity defines a shape in the form of a Greek cross that corresponds with the external shape of the structural member, and having four views extending along the longitudinal axis, which four views are defined so that the structural member defines a four-fold rotational symmetry around the longitudinal axis, each rotationally symmetric view consisting of (i) a support surface configured to serve as a support and as a fastening point for the panel and (ii) two connection surfaces that are configured for fastening of the structural member to other structural members, wherein in each of the four views the respective support surface of the respective view is positioned between the two connection surfaces of the respective view and is parallel to the two connection surfaces of the respective view, which connection surfaces of the respective view are disposed recessed relative to the support surface of the respective view at a spacing configured so that, when the structural member is fastened with fasteners via the connection surfaces of the respective view, the fasteners do not protrude beyond the support surface of the respective view, and for each of the four rotationally symmetric views, the connection surfaces thereof are joined to the support surface thereof by connection walls of other of the rotationally symmetric views lying on opposite sides of said support surface, and said connection walls of other of the rotationally symmetric views are positioned at a spacing from each other and are perpendicular to the connection surfaces of the respective view, wherein the panel is fastened to one of said support surfaces and the connection walls include a regular hole pattern configured to serve as passages for the fasteners to be received therethrough.

2. An assembly according to claim 1, in which the support surface and the connection surfaces extend over an entire axial length of the structural member.

3. An assembly according to claim 1, wherein the structural member defines a tubular shape.

4. An assembly according to claim 1, wherein legs of the structural member are perpendicular to each other, and wherein crosscut edges of the legs define the support surfaces and side surfaces of the legs define the connection surfaces.

5. An assembly according to claim 1, wherein the structural member defines a constant cross section along the longitudinal axis.

6. An assembly according to claim 1, wherein the support surfaces define a width of at least 20 mm.

7. An assembly according to claim 1, wherein the structural member is made from metal.

8. An assembly according to claim 7, wherein the structural member is made from steel.

9. An assembly for framework structure, comprising two structural members according to claim 1, wherein the structural members are joined to each other by one or more connection pieces made from sheet metal and fasteners, wherein the one or more connection pieces are fastened to at least one of the connection surfaces of each of the two structural members by fasteners received through holes of the hole pattern in each of said connection surfaces of the two structural members.

10. An assembly according to claim 9, wherein said connection pieces are fastened to the connection surfaces of at least two of the rotationally symmetric views of each of said two structural members.

11. An assembly according to claim 8, wherein the two structural members each define cross sections with identical dimensions.

12. An assembly according to claim 9, wherein the two structural members are arranged transverse to each other and a connection surface of a first one of said two structural members meets two mutually oppositely arranged connection surfaces of the other of said two structural members, wherein the one or more connection pieces each comprise a C-shaped member with two legs connected together by an intermediate part, wherein the legs are located on the oppositely arranged connection surfaces, and the intermediate part is located on said connection surface of the first one of said two structural members, that meets the two mutually oppositely arranged connection surfaces, and wherein the legs of the C-shaped member include passages that align with the holes through which said fasteners are received.

13. An assembly according to claim 9, wherein the two structural members define dimensions whereby the fasteners do not protrude beyond the support surface of the view including the connection surface to which the fasteners are connected in a direction perpendicular to said support surface.

14. An assembly according to claim 9, wherein the two structural members are not oriented parallel to each other and one of the two structural members defines a straight cut at an end thereof over an entire cross section thereof and is positioned with said end against said other of said two structural members.

15. An assembly according to claim 9, wherein the fasteners are blind rivets.

16. A framework structure comprising the assembly of claim 9.

17. A framework structure according to claim 16, further comprising a facing panel fastened onto support surfaces of the two structural members.

18. An assembly according to claim 1, wherein the thin-walled material defines an external cross-section of the structural member and the internal cavity defines a cross-section that substantially corresponds with the external cross section of the structural member.

19. An assembly according to claim 1, wherein the structural member defines a wall thickness not greater than about 3 mm.

20. An assembly according to claim 1, wherein the structural member defines outside dimensions such that a smallest square within which a cross section thereof is inscribed has a side of at least about 70 mm and no greater than about 200 mm.

21. An assembly according to claim 1, wherein the support surfaces define a width of at least about 30 mm.

22. An assembly according to claim 1, wherein legs of the structural member define a U-shape.

23. An assembly according to claim 1, wherein legs of the structural member are hollow.

* * * * *